US011850529B2

(12) United States Patent
Browning, Jr.

(10) Patent No.: US 11,850,529 B2
(45) Date of Patent: Dec. 26, 2023

(54) INDOOR ZIP COASTER WITH STATIONS

(71) Applicant: Michael Browning, Jr., Bedford, TX (US)

(72) Inventor: Michael Browning, Jr., Bedford, TX (US)

(73) Assignee: UATP IP, LLC, Bedford, TX (US)

( * ) Notice: Subject to any disclaimer, the term of this patent is extended or adjusted under 35 U.S.C. 154(b) by 29 days.

(21) Appl. No.: 16/720,734

(22) Filed: Dec. 19, 2019

(65) Prior Publication Data

US 2020/0197823 A1 Jun. 25, 2020

Related U.S. Application Data

(60) Provisional application No. 62/782,546, filed on Dec. 20, 2018.

(51) Int. Cl.

| | |
|---|---|
| ***A63G 21/20*** | (2006.01) |
| ***A63G 21/22*** | (2006.01) |
| ***B61B 3/00*** | (2006.01) |
| *B61B 7/00* | (2006.01) |

(52) U.S. Cl.

CPC ..... *A63G 21/20* (2013.01); *A63G 21/22* (2013.01); *B61B 3/00* (2013.01); *B61B 7/00* (2013.01)

(58) Field of Classification Search

CPC ..... A63G 21/20; A63G 21/22; B61B 3/00; B61B 7/00

USPC ..... 104/91, 112, 113

See application file for complete search history.

(56) References Cited

U.S. PATENT DOCUMENTS

| | | | | |
|---|---|---|---|---|
| 10,220,859 | B2 | 3/2019 | Reese et al. | |
| 2006/0189453 | A1* | 8/2006 | Leblond | A63B 71/0009 482/69 |
| 2015/0217783 | A1* | 8/2015 | Horihan | A63G 21/22 104/113 |
| 2016/0046305 | A1* | 2/2016 | Cylvick | B61L 21/10 701/19 |

(Continued)

OTHER PUBLICATIONS ipZag Rides Limited, Gravity-powered air time product guide, 6 pages, Nov. 2018.

(Continued)

*Primary Examiner* — Zachary L Kuhfuss

(74) *Attorney, Agent, or Firm* — Brian K. Yost; Decker Jones, PC

(57) ABSTRACT

An indoor zip coaster has a zip coaster rail suspended above ground and forming a closed loop. At least one trolley located is on the rail, with a rider tethered to the trolley by a harness. The rail has plural sections, with each section of the rail including an incline portion and a decline portion. The trolley traverses the respective incline portion of one of the sections before traversing the respective decline portion of the one section. Each of the stations contains a respective incline portion of rail, a ramp for the rider to climb. The decline portion of rail of the next section extends from one station to the next station. By including stations with inclined portions of rail along the zip coaster path, a longer ride can be obtained. In addition, sensors and gates can be provided at the stations to allow a single rider on each rail section, with multiple riders on the overall zip coaster spread among the sections.

9 Claims, 7 Drawing Sheets

(56) References Cited

U.S. PATENT DOCUMENTS

| | | | | |
|---|---|---|---|---|
| 2016/0144869 | A1* | 5/2016 | Burroughs | A63G 21/22<br>104/53 |
| 2017/0036123 | A1* | 2/2017 | Liggett | B61B 3/00 |
| 2017/0120935 | A1* | 5/2017 | Reese | A63G 21/20 |
| 2018/0272172 | A1* | 9/2018 | Browning, Jr. | A63G 33/00 |
| 2021/0016116 | A1* | 1/2021 | Liggett | A62B 35/0087 |

OTHER PUBLICATIONS

ZipZag Rides Limited, Gravity-powered air time product guide, 6 pages, Nov. 2018.†

* cited by examiner
† cited by third party

INDOOR ZIP COASTER WITH STATIONS

FIELD OF THE INVENTION

The present invention relates to indoor zip or rail coasters.

BACKGROUND OF THE INVENTION

A zip coaster, or rail coaster, is a track type of ride for passengers or riders. A rail or track is inclined downward and supports a moveable trolley. A rider is suspended beneath the trolley by way of a harness and rides the rail, with gravity providing the required force.

Zip coaster rails are commonly provided in closed loop form. This allows the trolley to stay on for the entire ride and in moving the trolley from a finishing area to a starting area. In addition, the rail is typically provided with curves that seek to take advantage of centrifugal force applied to the rider and have the rider swing laterally from the rail during the descent, somewhat similar to a car tilting to the outside during a fast unbanked turn.

The rail passes through a boarding platform. The boarding platform has the starting area, where a rider embarks to ride the rail, and a finishing area, where the rider disembarks from the rail. The rail at the starting area is elevated off the ground. The rider rides the downwardly inclined rail from the starting area to the finishing area. The rail at the finishing area is at a lower elevation than at the starting area. The boarding platform is staffed with trained personnel who, for safety reasons, secure the rider to the trolley with a harness before the rider passes through the starting area, and then disconnects the rider from the trolley at the finishing area. Inside the boarding platform, the rider typically is secured to the trolley by a harness and then moves up an incline to an elevated platform, which is the starting area. The rider pulls the trolley along the rail. The rider steps off the elevated platform to ride the zip coaster. The zip coaster rail returns to the boarding platform at the finishing area, where the rider is disconnected from the trolley.

Providing a zip coaster in an indoor area provides advantages over an outdoor zip coaster. The indoor zip coaster can be used year round, regardless of the weather. The zip coaster rail can be suspended from the existing ceiling of the indoor area and does not need additional structure or poles.

An indoor zip coaster however suffers from the disadvantage of limited height, which is constrained by the ceiling. This in turn limits the length of the zip coaster. A typical zip coaster has a horizontal run of 20 feet for every one foot vertical drop. In contrast, an outdoor zip coaster is unconstrained by ceiling. The uppermost height of an outdoor zip coaster is accessible by stairs, etc.

Thus, it is desired to provide longer indoor zip coasters.

SUMMARY OF THE INVENTION

An indoor zip coaster comprises a zip coaster rail suspended above ground and forming a closed loop. At least one trolley is located on the rail, with a rider who is suspended under the trolley being capable of riding along the rail. First and second stations are located along the rail. The rail has plural sections, with each section of the rail including an incline portion and a decline portion. The trolley traverses the respective incline portion of one of the sections before traversing the respective decline portion of the one section. Each of the first and second stations contains the respective incline portion of the respective section and a ramp for the rider to climb. The respective decline portion of rail of a section extends from one of the first and second stations to the other of the first and second stations.

In accordance with one aspect, the indoor zip coaster further comprises a building that contains the zip coaster rail. The building has a ceiling, the ceiling having a height, with the incline portion of each of the sections limited in height by the ceiling height.

In accordance with another aspect, the indoor zip coaster further comprises a third station located along the rail, the rail comprising at least three sections.

In accordance with another aspect, the indoor zip coaster further comprises a fourth station located along the rail, the rail comprising at least four sections.

In accordance with another aspect, each of the decline portions has a slope, with a length of the zip coaster rail determined by the cumulative slopes.

In accordance with another aspect, the indoor zip coaster further comprises a gate located at at least one of the first or second stations. The gate is movable between open and closed positions by a gate actuator, with the gate in the closed position blocking movement of the trolley in a forward direction and with the gate in the open position allowing movement of the trolley in a forward direction. A sensor is located along the respective rail section associated with the gate. The sensor is capable of sensing the trolley. A controller has an input from the sensor and an output to the gate actuator. The controller causes the gate to be closed while a trolley is located in the respective rail section.

In accordance with another aspect, the sensor is an entry sensor located at an entry to the respective rail section. The indoor zip coaster further comprises an exit sensor located at an exit of the respective rail section. The exit sensor is connected to the controller. The controller causes the gate to be closed while a trolley is between the entry and exit sensors on the respective rail section.

DESCRIPTION OF THE PREFERRED EMBODIMENT

The indoor zip coaster has, in addition to a boarding platform, plural inclined sections of rail which provide a longer zip coaster ride. Each section has a rise portion of rail and a decline portion of rail. Stations are located at the end of one section and the beginning of the next section. At a station, a rider finishes the decline portion of the last section of rail, and begins the next section by climbing up to the next rise portion. At the top of the rise portion, the rider leaves a platform to ride the next decline portion of rail to the next station. By providing a number of rise portions in the rail, the cumulative elevation of the zip coaster ride is increased, and the horizontal length of the ride is increased accordingly.

Another feature is that only one station needs to be manned by staff. This is the main station, where riders are connected to and taken off of the trolleys. The remaining, or satellite, stations need not be manned or staffed. This allows the ride operator to reduce operating costs.

Still another feature allows plural riders on the zip coaster at the same time. Each section has a maximum of one rider. Each station has a gate that opens to allow a rider to ride the next section when that section is empty of another rider. Sensors detect the presence of a rider on a section and a controller operates the gate. This allows for increased throughput and utilization of the zip coaster, benefiting the ride operator. This also allows the use of unstaffed stations, apart from the main station.

In the description that follows, terms such as "upstream" and "downstream" may be used, with reference to the direction of movement of a rider along the rail. A rider moves in a downstream direction along the rail.

Figure 1:
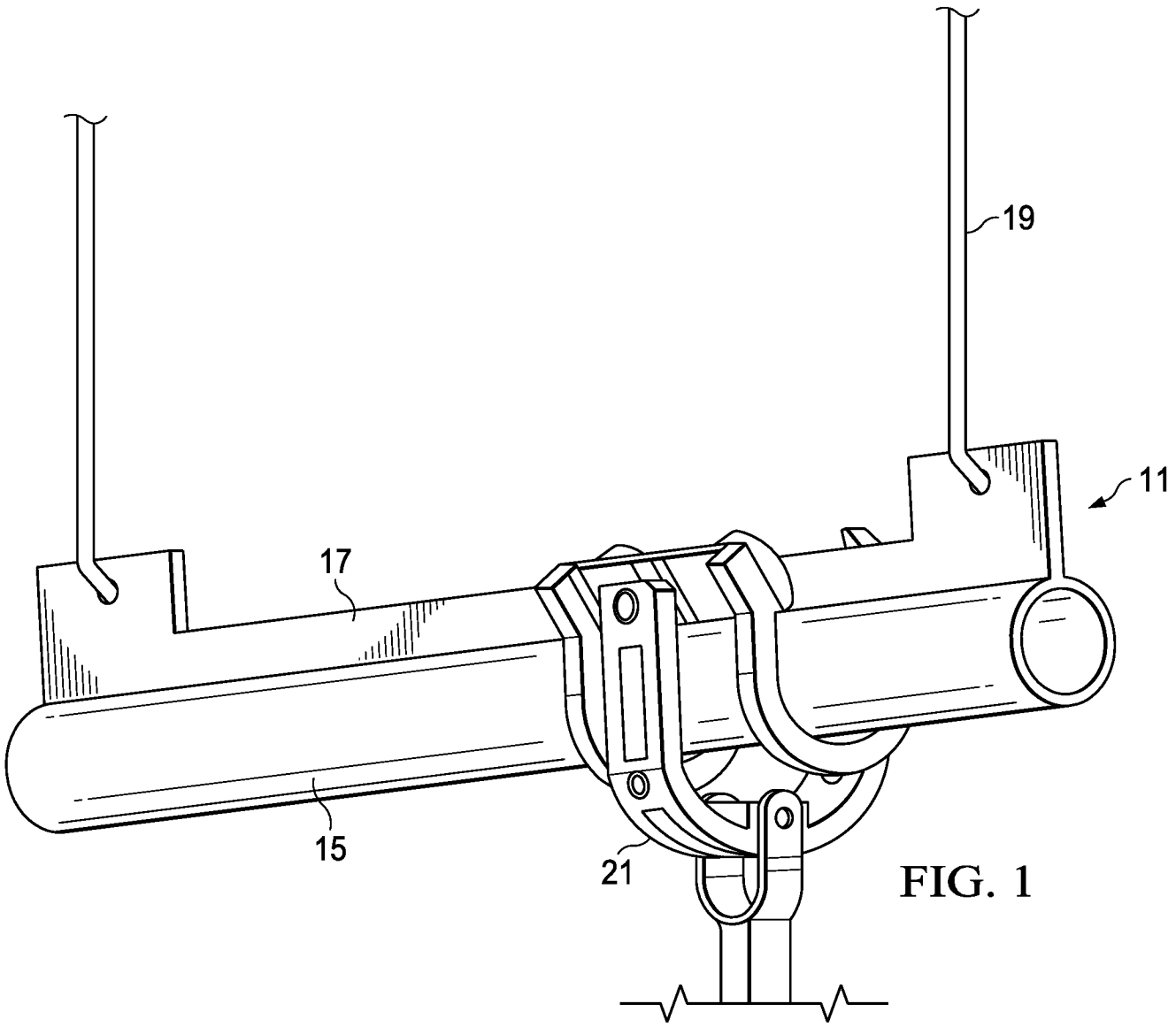
FIG. 1 is a perspective view of a length of zip coaster rail, shown with a trolley.

Zip coasters are well known. U.S. Patent Application No. 20170120935, the entire disclosure of which is incorporated herein by reference, describes a zip coaster. In general and referring to FIG. 1, the zip coaster 11 has a rail 15 which is a cylindrical tube. An upstanding flange 17 extends along the top of the tube and forms a spine. The rail is supported off of the ground by cables 19 that couple to the flange. As discussed in more detail below, the rail ascends and descends relative to the floor of the building.

Several trolleys 21 are provided on the rail. Each trolley has wheels that contact the tube. A trolley may have four wheels, with one pair contacting the upper portions of the tube on each side of the flange at a forward position, and the other pair contacting the upper portions of the tube on each side of the flange at an aft position. The wheels allow the trolley to move with little friction along the rail tube.

Figure 2:
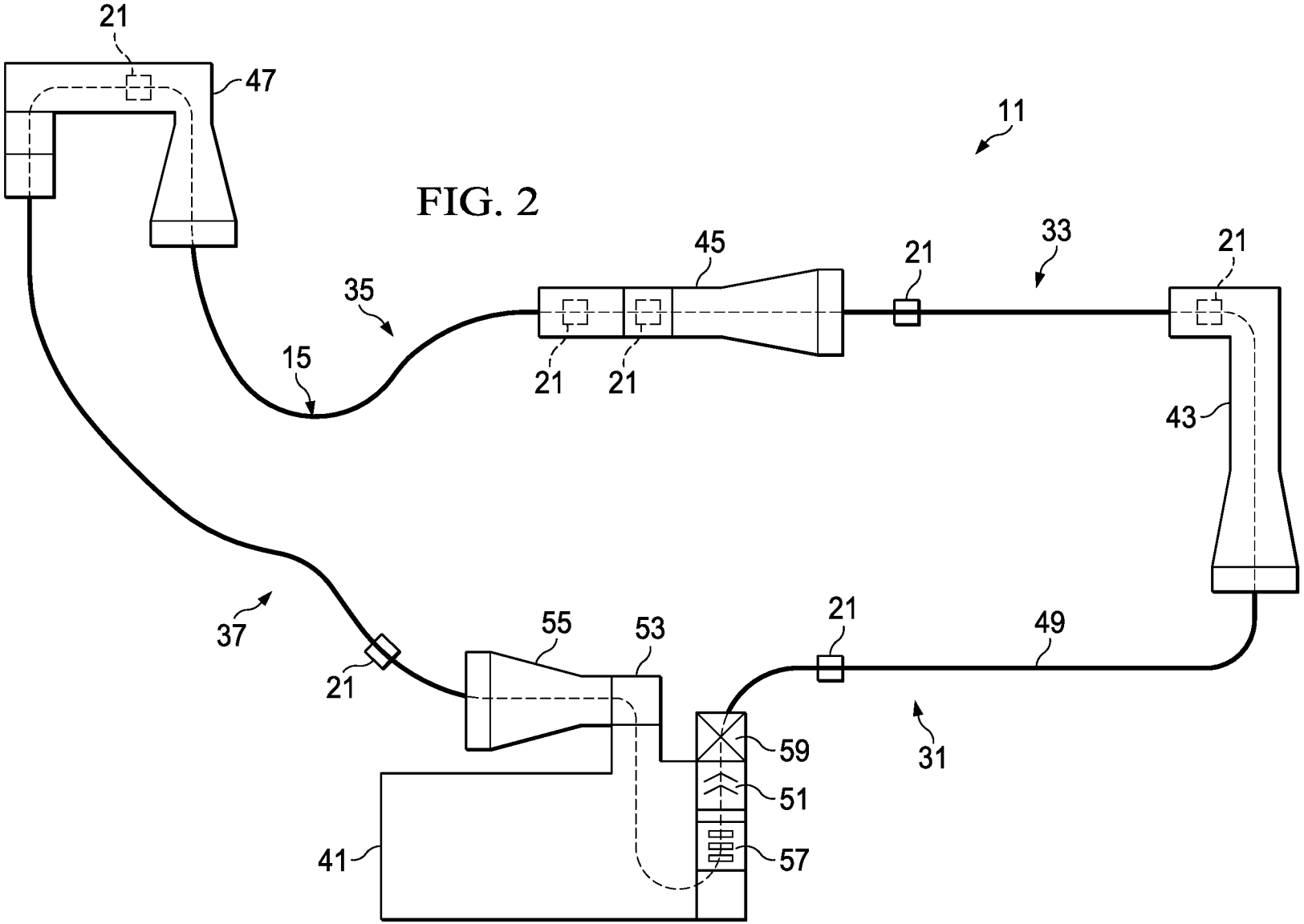
FIG. 2 is a plan view of a zip coaster, in accordance with a preferred embodiment.

Referring to FIG. 2, the rail 15 forms a closed loop. The layout of the rail need not be circular or oval and may have a variety of curves, allowing the rider to swing from side to side. Thus, some of the curves allow the rider to swing to the outside of the loop, while other curves allow the rider to swing to the inside of the loop.

Figure 3A:
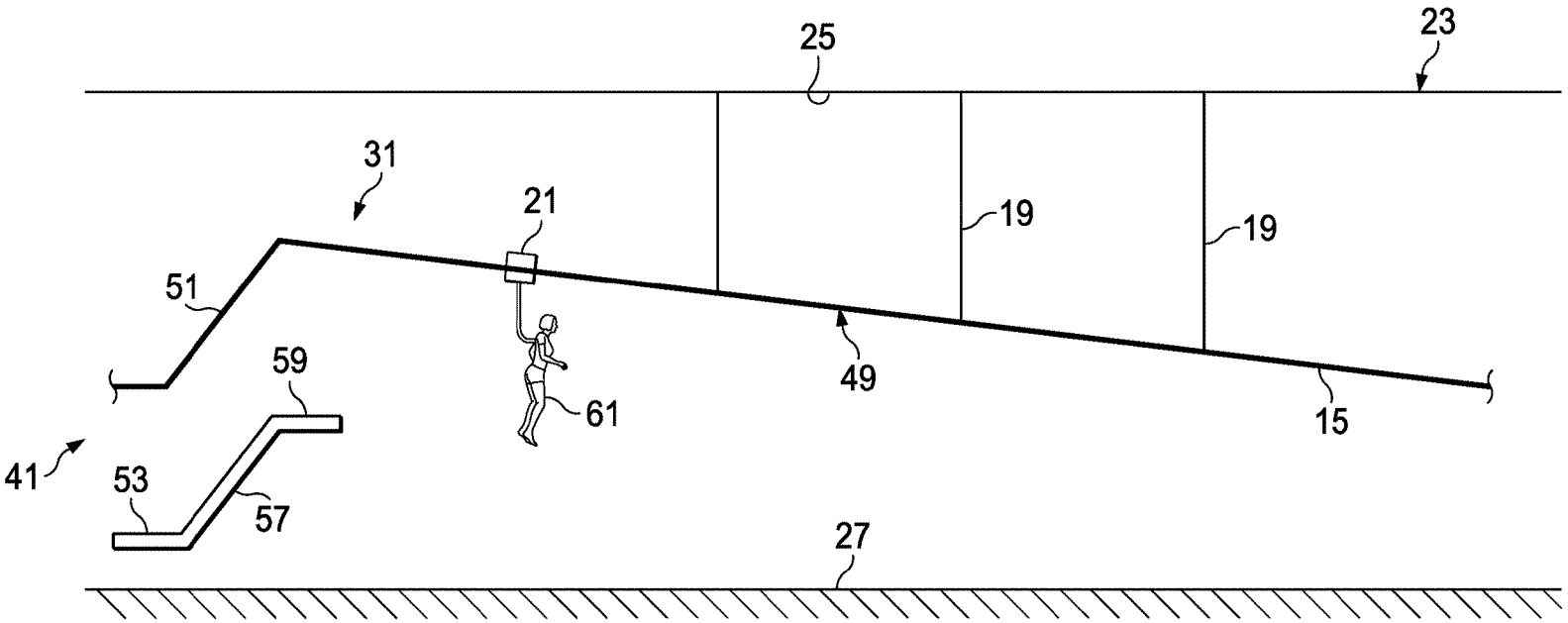
FIGS. 3A-3D are schematic side elevational views of the zip coaster of FIG. 1, shown straightened to illustrate the changes in elevation.

Referring to FIG. 3A, the zip coaster 11 is located inside of a structure, such as a building 23. (In FIGS. 3B-3D, the building is not shown, for illustrative purposes.) The building has a ceiling 25, a floor 27 and walls, as well as an entrance from the exterior. Preferably, the building has climate control, such as air conditioning and heating. The cables 19 that support the rail can be supported by the ceiling 25, by columns, or other suitable structure.

Figure 3B:
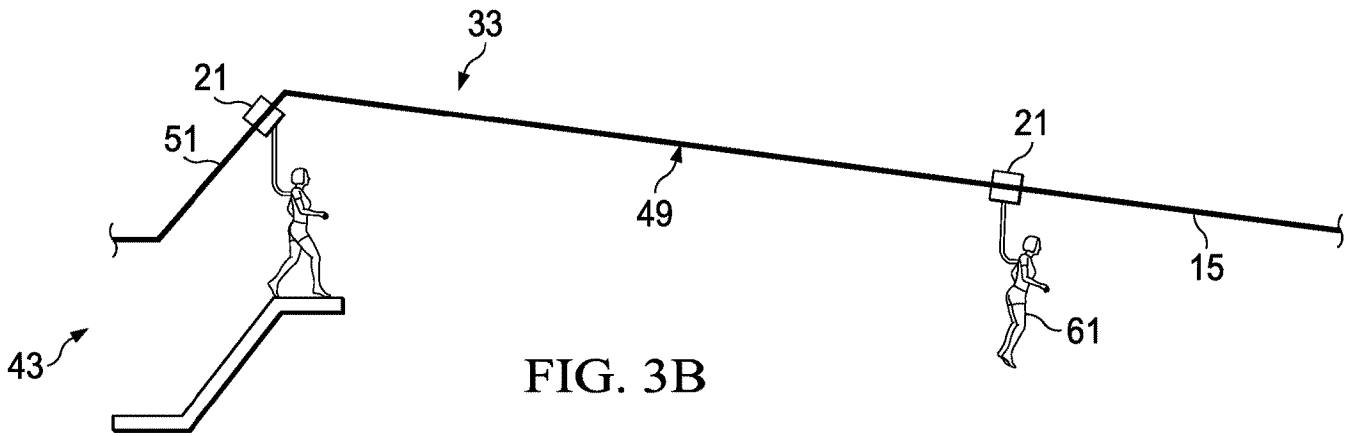
Figure 3C:
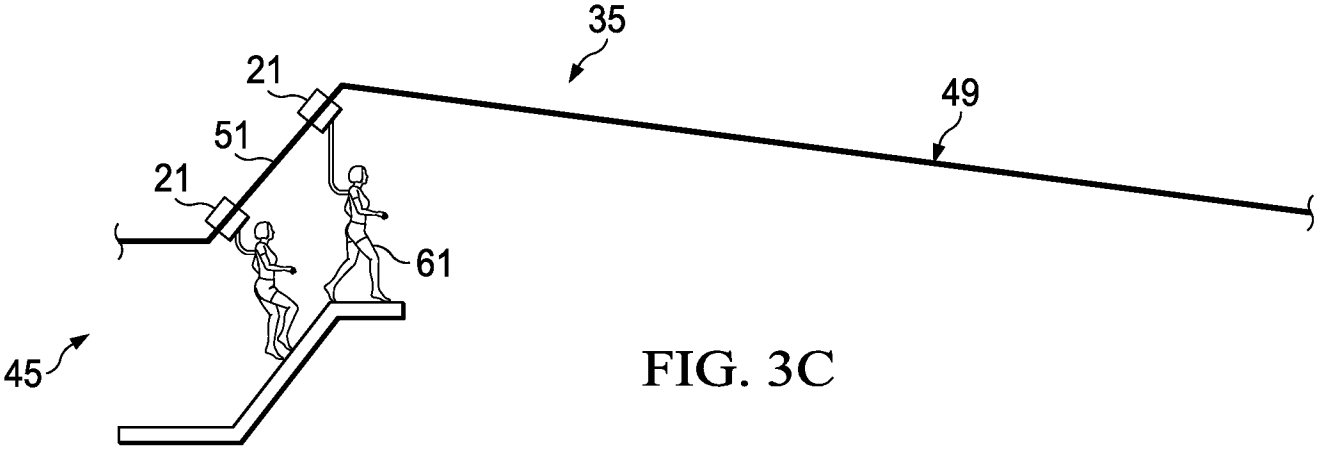
Figure 3D:
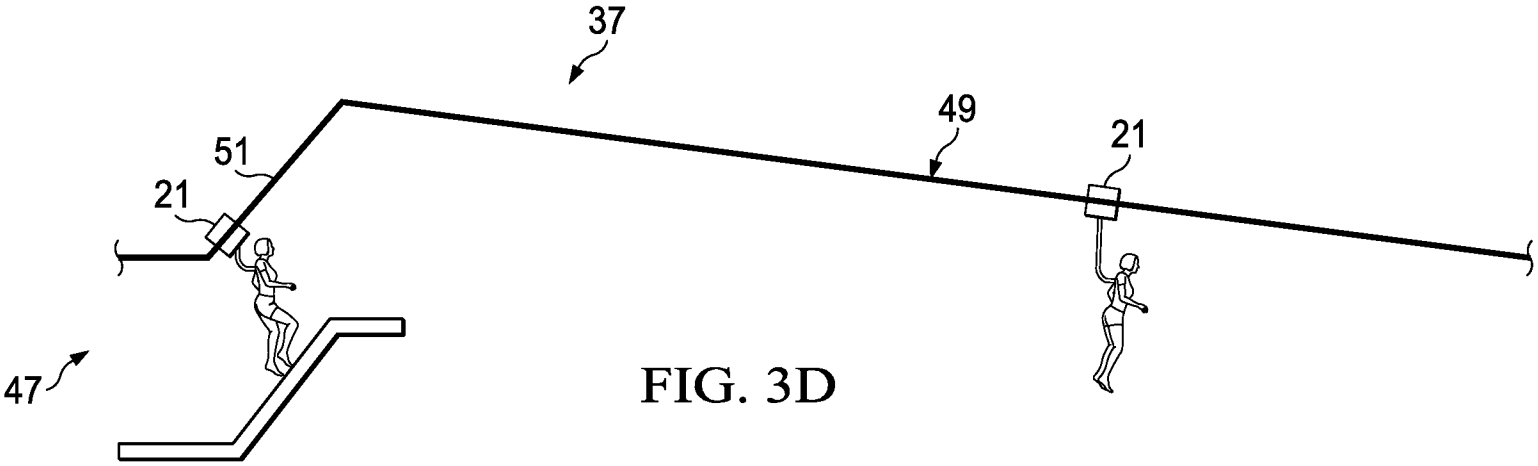

In the embodiment shown in FIGS. 2-3D, the zip coaster has several sections. (FIGS. 3A-3D show the zip coaster rail as straightened in order to illustrate the changes in elevation.) A first section 31 begins at a main station 41 (see FIGS. 2 and 3A). The first section of the zip coaster traverses over an area of the building and ends at a first satellite station 43. A second section 33 of the zip coaster begins at the first satellite station, traverses over an area of the building and ends at a second satellite station 45 (see FIGS. 2 and 3B). A third section 35 of the zip coaster begins at the second satellite station, traverses over an area of the building and ends at a third satellite station 47 (see FIGS. 2 and 3C). A fourth section 37 of the zip coaster begins at the third satellite station, traverses over an area of the building and ends at the main station 41 (see FIGS. 2 and 3D).

Between stations, each section of zip coaster rail descends along a respective decline portion 49, thereby allowing a rider tethered to the trolley to ride along the rail, pulled along by gravity.

The end of the decline portion of the zip coaster rail enters a station. The decline portion of the rail transitions into the next incline portion 51 of the next section. The rail may have a short horizontal span before it transitions into the next section and specifically the incline portion of the next section. Alternatively, the rail may transition directly from the decline portion to the next incline portion. The rail may also have a short horizontal span between the incline portion and the decline portion. This horizontal span is located above the launch platform 59 (discussed below).

Each station has a horizontal landing platform 53 for the rider to contact with the rider's feet, as the rider enters the station on the decline portion. A funnel type wall 55 may be used to surround the rail to constrain lateral movements of the rider. The funnel type wall is located upstream of the landing platform. The landing platform 53 transitions to a ramp 57, which is located under the incline portion 51. The rider is able to climb the ramp and pull the trolley along the rail. The ramp transitions to a horizontal launch platform 59. The launch platform 59 is elevated above the landing platform 53. The rider is able to step off of the edge of the launch platform and become fully suspended by the trolley. In addition, the decline portion of the next section begins. The exact beginning of the decline portion can be located above the edge of the launch platform, or it can be located above the part of the launch platform.

The rail can be of various configurations in a station when viewed in plan view. For example, referring to FIG. 1, the rail can be straight, with no horizontal curves or bends. The rail can also have one or more horizontal curves, such as a 45 degree curve, a 90 degree curve and/or a 180 degree curve. The radius of the curve can be much smaller than the radius of a curve out away from a station, where the rider is riding the zip coaster. For example, the radius of a curve inside a station could be 2 feet, while the radius of a curve outside a station, would be larger, such as 12 feet. This allows tight turns in close quarters, and permits the positioning of the stations at the boundaries of the overall zip coaster area of the building.

In addition, the slope of the incline section of rail is higher, steeper, than the slope of the decline section of rail. This allows the incline section to gain elevation in a relatively shorter horizontal distance, compared to the loss of elevation in the decline section.

In use, the rider 61, wearing a harness, is coupled to a trolley 21 at the main station 41 (FIG. 3A), between the incoming decline portion 49 and the outgoing incline portion 51 of rail. An attendant assists in this procedure. The attendant may also provide instruction to the rider on how to ride the zip coaster. Once coupled to the trolley, the rider climbs the ramp 57, pulling the trolley along the incline portion 51 of the rail. This is the beginning of the first section 31 of rail. The rider reaches the launch platform 59 and then steps off the edge to become suspended by the rail and the trolley. The rider 61 rides the trolley 21 down and along the decline portion 49 of the rail first section 31. The rider then enters the landing platform of the first station 43 (FIG. 3B). There the trolley moves from the first section 31 to the second section 33 of rail. The rider gains elevation by climbing the ramp to the launch platform of the first station. The rider then steps off the launch platform the ride the decline section of rail of the second station.

The process of a rider landing in a station and climbing to the higher launch platform repeats for the number of stations in the zip coaster. All this while, the trolley 21 remains on the rail 15 and the rider 61 remains tethered to the trolley. The rider is able to extend the ride horizontally with every climb up in every station.

Finally, the rider enters the main station 41 and stands on the landing platform 53. There, the attendant uncouples the rider from the trolley. Another rider is coupled to the same trolley or a more downstream trolley for a ride.

In addition to extending the length of the ride, the stations allow plural riders on the zip coaster at any given time. A control system is provided in order to meter rider traffic at the stations. The control system ensures that only one rider is on any given rail zone, in order to prevent collisions between riders.

An operator may allow more than one rider in a station. When a rider is moving or zipping along the decline portion of the rail, the risk of collision with another rider on the same portion of rail would be high, as the riders have little or no control over their descent. However, when riders are in a station, the riders are not zipping down along the coaster, but instead have their feet on a platform. This diminishes the risk of injury due to collision between riders.

If an operator allows more than one rider in a station, block zones are used. Block zones are lengths of the rail that are shorter than a rail section. A block zone begins on the rail above a launch platform 59 and ends on the rail located above the subsequent landing platform 53. Thus a block zone is mostly the decline portion 49 of a rail section, and may include the entry and exit rail segments therefrom. An intermediate area is located between adjacent block zones. The intermediate area includes the ramp 57 and may include a portion of the landing platform 43 adjacent to the ramp, as well a portion of the launch platform 49 adjacent to the ramp.

Figure 4:
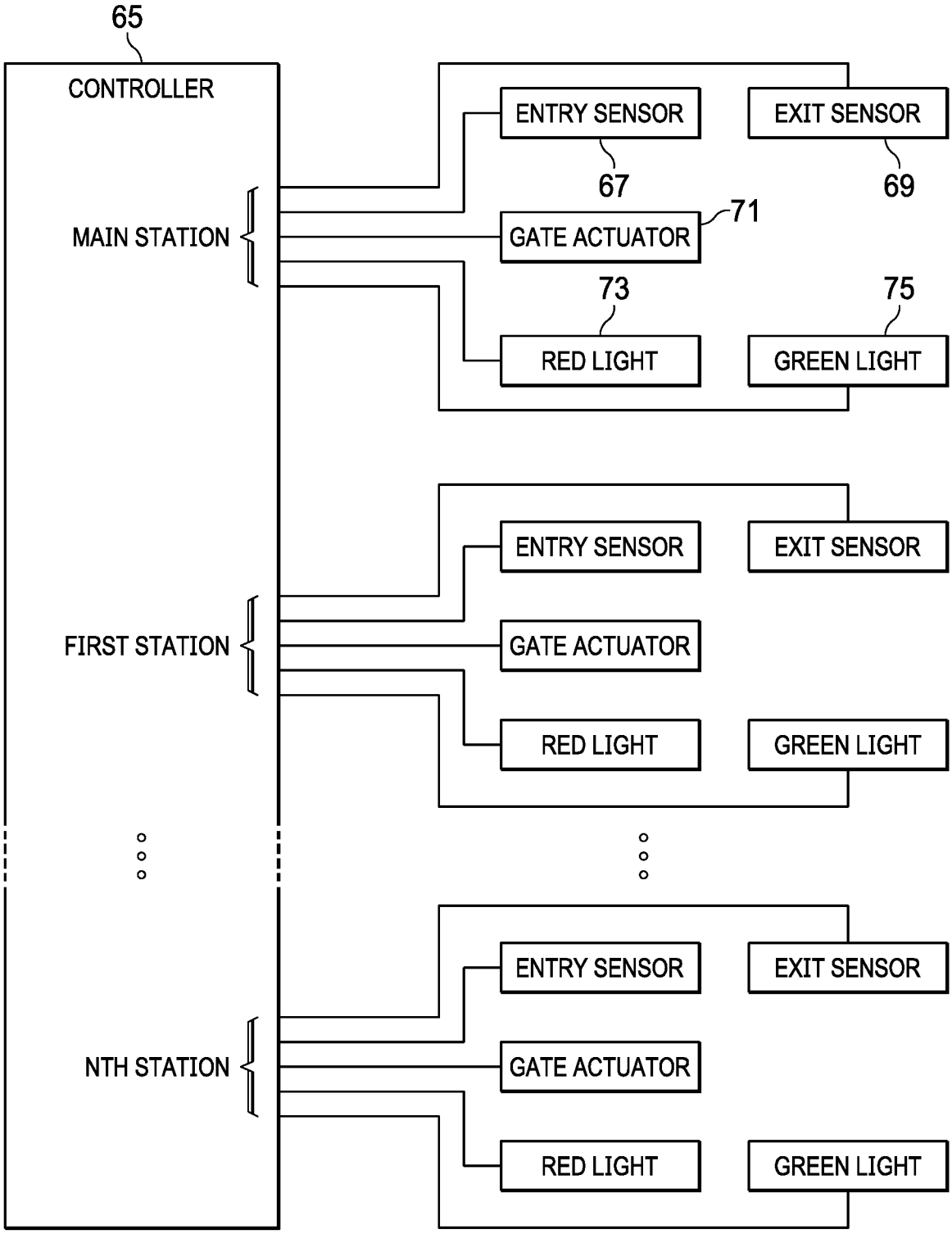
FIG. 4 is a block diagram of the control system.
Figure 6:
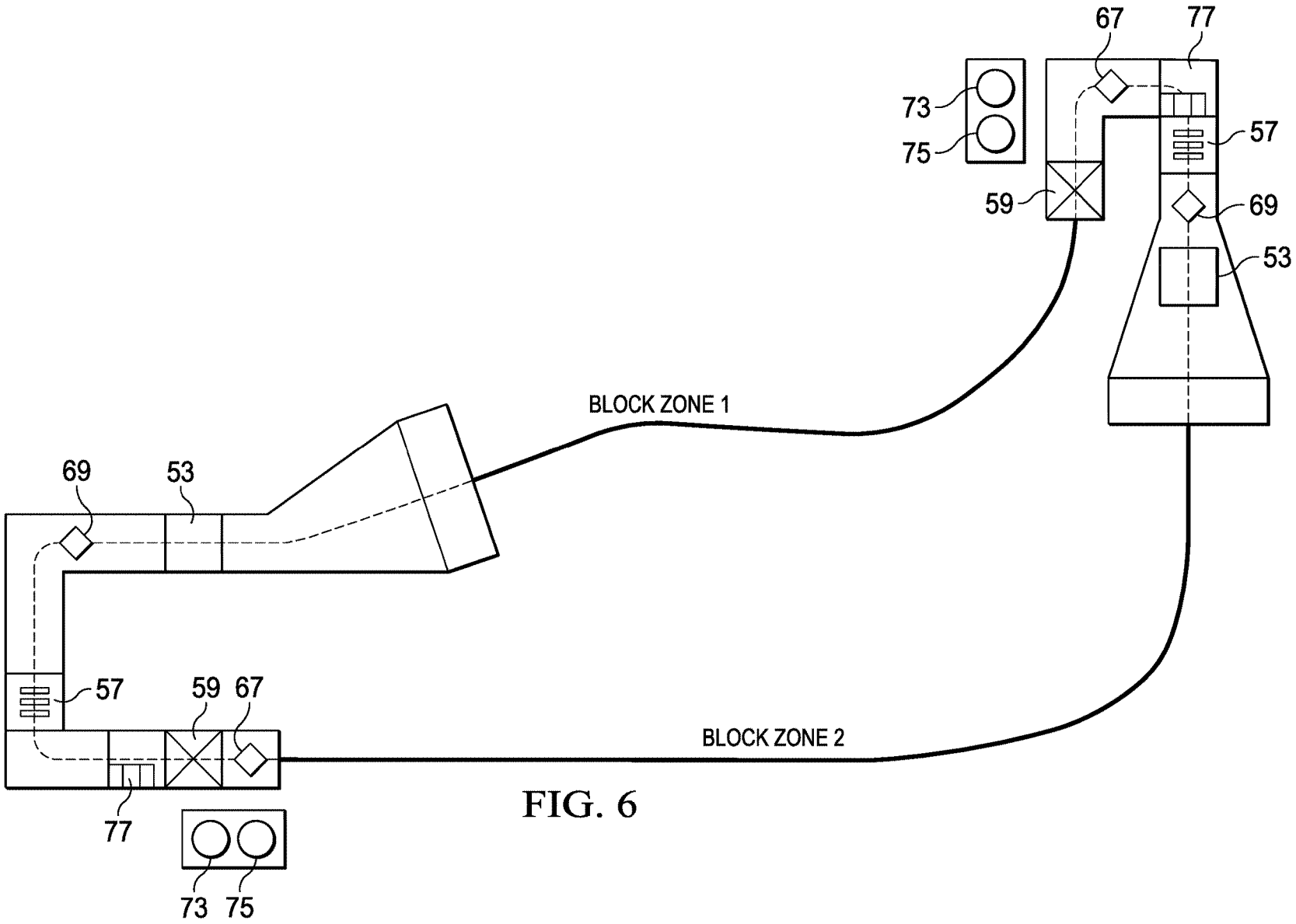
FIG. 6 is a plan view of a zip coaster, in accordance with another embodiment, illustrating block zones and sensor locations.

Referring to FIGS. 4 and 6, the control system has a controller 65, sensors 67, 69, gate actuators 71, indicator lights 73, 75 and gates 77. The controller 65 is a processor and may be a PLC (Programmable Logic Controller). The controller has inputs and outputs. The sensors 67 are provided as inputs into the controller. The gate actuators 71 and indicator lights 73, 75 are provided as outputs from the controller.

The sensors 67, 69 sense the presence of a rider and trolley 21 along a block zone of rail. In the preferred embodiment, each block zone of rail has two sensors. An entry sensor 67 is at or near the beginning of the block zone, to monitor the entry of a rider into the zone. An exit sensor 69 is at or near the end of a zone, to monitor the exit of a rider from the zone.

Although various types of sensors could be used, in the preferred embodiment, the sensors sense the trolley at, or moving through, a particular point along the rail. The sensors 67, 69 can be proximity sensors mounted on a flange of the rail and positioned to sense a trolley moving along the rail. The sensors could also be mechanical switches, each having a spring loaded arm. As a trolley moves past the sensor, the arm is moved by the trolley. This movement is sensed by the sensor. The spring returns the arm to an original position after the trolley has passed. Still other types of sensors sense the passage of a rider along the route. For example, a beam sensor could be used to sense the rider. As the rider moves along the route past a point, the rider interrupts the beam, which interruption is sensed.

In the preferred embodiment, the entry sensor 67 is located on the rail after, or downstream of, the gate 77. The gate will be described in more detail below. The gate 77 and the entry sensor 67 are located on the rail at the beginning of a block zone, above the launch platform 59. The exit sensor 69 is located at the end of a block zone, typically at the end of the landing platform 43.

As an alternative to two sensors 67, 69 per zone, a single sensor can be used. In this single sensor embodiment, the sensor is an entry sensor just downstream of the gate. This sensor monitors the rider's exit from the previous zone and entry into the next zone. The block zone would be substantially the same as a rail section.

Each station has indicator lights 73, 75 to give a rider an indication of whether to go or to stop. There is a green indicator light 75 and a red indicator light 73. The lights are located so as to be viewed by a rider who is stopped behind a gate 77.

Figure 5:
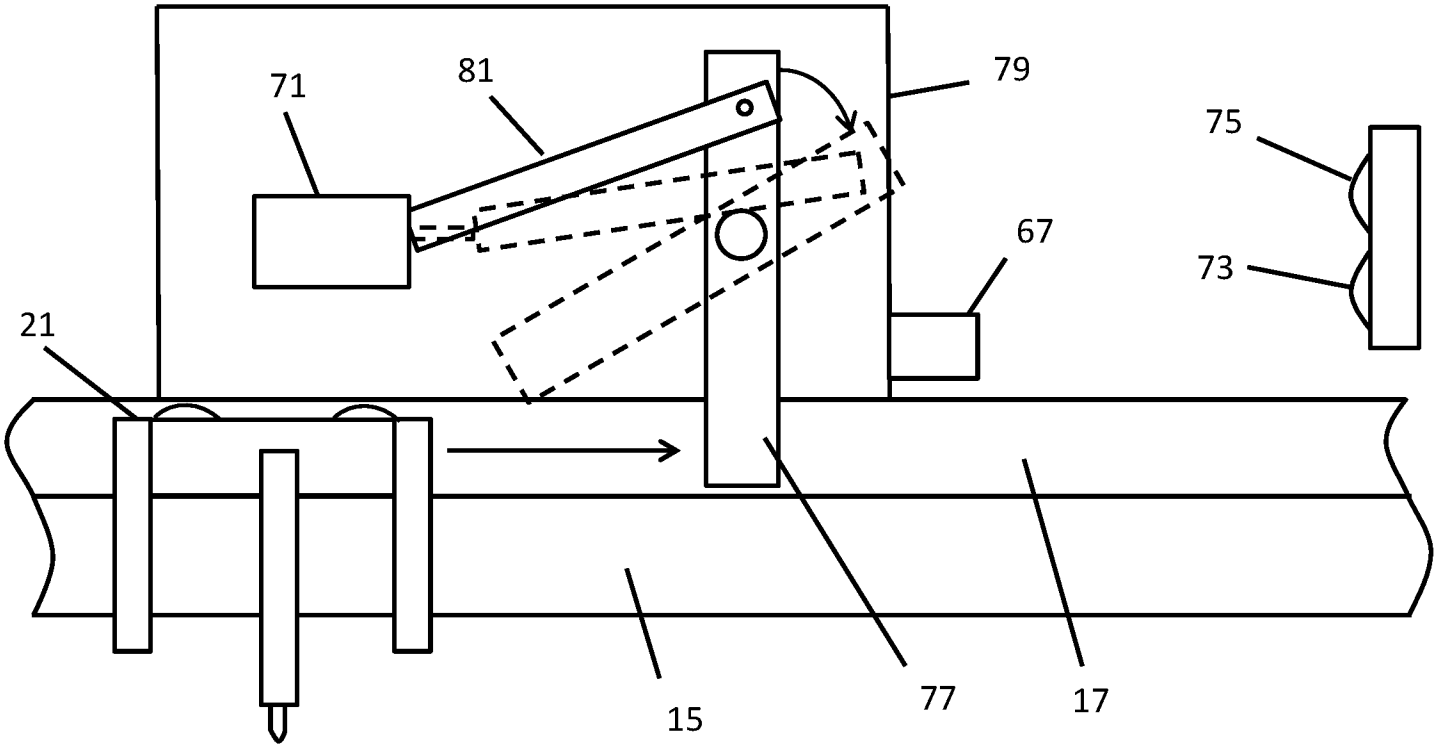
FIG. 5 is a side view of the rail with a gate and a sensor.

An example gate 77 is shown in FIG. 5. The gate 77 is pivotally mounted to a bracket 79, which bracket is in turn mounted to the flange 17. The actuator 71 is also mounted to the bracket 79. The actuator moves the gate 77 between a closed position (shown in solid lines in FIG. 5) and an open position (shown in dashed lines). In the closed position, the gate 77 is located so as to extend down along one side of the flange 17 and stop the trolley 21 from moving forward along the rail 15. Because the trolley 21 has wheels that are located adjacent to the flange, the gate need not extend down along the rail, but only along a side of the flange 17. As an alternative, the gate could extend along both sides of the flange. The actuator 71 is connected to the upper end of the gate by a linkage 81. The actuator 71 moves one end of the linkage 81 in a linear motion. The other end of the linkage is pivotally coupled to the upper end of the gate. The actuator 71 moves the linkage 81 to open and close the gate. In the open position, the gate 77 is moved up and out of the way, allowing the trolley to pass through. The entry sensor 67 is also mounted to the bracket 79.

In operation, still referring to FIG. 6, a lead rider of a group of riders at one station climbs the ramp. On the launch platform, the progress of the trolley along the rail is controlled by the gate 77. If the gate is closed, the trolley and the lead rider are unable to enter the Block Zone 1 and thus unable to ride the zip coaster. If the gate is closed, a red light 73 indicates closure. When the first block zone is clear of a rider, the gate 77 opens and the red light turns off. The green light 75 turns on, indicating the rail in the first block zone is open. The lead rider then pushes through the open gate and off from the launch platform 59 to ride the rail along the decline portion. The entry sensor 67 detects a rider in the first block zone and the controller 65 turns the green light 75 off, turns the red light 73 on and closes the gate 77. The lights are typically behind the rider by this time, so the rider would not see the lights changing. A second rider behind the lead rider is prevented from entering Block Zone 1 by the gate.

The first rider traverses Block Zone 1 and lands on the landing platform of the next station. As the first rider clears the landing platform, the exit sensor 69 detects this. In response, the controller 65 opens the gate 77 at the one station, turns the green light 75 on and the red light 73 off. The second rider is now free to ride the zip coaster in Block Zone 1.

The first rider climbs the ramp in the next station and enters the launch platform. The first rider looks at the indicator lights to see if the rider can continue on. If Block Zone 2 is not clear, the red light 73 is on and the gate 77 is closed, preventing the rider from continuing into Block Zone 2. If the next block zone is clear, the controller opens the gate and turns the green light on. The rider is free to push or jump off and ride the rail along the second block zone. The second rider can ride the rail of Block Zone 1 or climb the ramp behind the first rider in the satellite station. As soon as the first rider goes through the gate and past the entry sensor, the controller closes the gate and illuminates the red light, thus preventing the second rider from colliding with the first rider in the second block zone.

The process repeats itself, metering riders one-by-one into a respective block zone. Thus, a number of riders can be on the zip coaster at any given time. Because the block zones are interspersed with intermediate areas in the stations, more riders can be on the zip coaster than block zones. Thus, for example, if a zip coaster has four block zones, more than four riders can be on the zip coaster at any one time. However, only four riders can be riding at the same time, and these four are in separate block zones, to prevent collisions. The remaining riders are located in the stations awaiting their turn.

Although the zip coaster has been described as having four sections and four block zones, fewer or more sections and block zones can be used.

The foregoing disclosure and showings made in the drawings are merely illustrative of the principles of this invention and are not to be interpreted in a limiting sense.

The invention claimed is:

1. An indoor zip coaster, comprising:

a) A zip coaster rail suspended above ground and forming a closed loop;

b) At least one trolley located on the rail, the trolley being adapted for a rider to be suspended under the trolley, the trolley having wheels structured and arranged to permit the trolley to ride along the rail;

c) A first station located along the rail at a first height;

d) A second station located along the rail at a second height, the second height being different than the first height;

e) The rail having plural sections and plural incline and decline portions, the first station containing a first section, the second station containing a second section, the trolley and rail being structured and arranged to permit the trolley and the rider suspended under the trolley to move along the rail from the first section to the second section, the first station containing a first station incline portion and a first station decline portion the first station incline portion and the first station decline portion forming a first station apex, said first station apex configured to permit the trolley to continuously move along the rail through the first station, the second station containing a second station incline portion and a second station decline portion the second station incline portion and second station decline portion forming a second station apex, said second station apex configured to permit the trolley to continuously move along the rail through the second station, with the trolley traversing the respective incline portion of one of the stations before traversing the respective decline portion of the one station;

f) Each of the first and second stations containing a ramp for the rider to climb upward while the rider is coupled to the trolley while the trolley rides along the rail, the ramp contained within the first station being different than the ramp contained within the second station, the respective decline portion of rail of a section extending from one of the first and second stations to the other of the first and second stations.

2. The indoor zip coaster of claim 1, further comprising a building that contains the zip coaster rail, the building having a ceiling, the ceiling having a height, the incline portion of each of the stations limited in height by the ceiling height.

3. The indoor zip coaster of claim 1, further comprising a third station located along the rail, the rail comprising at least three sections wherein:

the third station contains a third section;

the third station contains a third station incline portion and a third station decline portion;

the third station contains a ramp for the rider to climb upward while the rider is coupled to the trolley, the ramp contained within the third station being different than the ramps contained within the first and second stations.

4. The indoor zip coaster of claim 1, further comprising a fourth station located along the rail, the rail comprising at least four sections wherein:

the fourth station contains a fourth section;

the fourth station contains a fourth station incline portion and a fourth station decline portion;

the fourth station contains a ramp for the rider to climb upward while the rider is coupled to the trolley, the ramp contained within the fourth station being different than the ramps contained within the first, second, and third stations.

5. The indoor zip coaster of claim 4, wherein the fourth station is located along the rail at a fourth height, the fourth height being different from at least one of the first, second, and third heights.

6. The indoor zip coaster of claim 3, wherein the third station is located along the rail at a third height, the third height being different from at least one of the first and second heights.

7. The indoor zip coaster of claim 1, wherein each of the decline portions has a slope, with a length of the zip coaster rail determined by the cumulative slopes.

8. The indoor zip coaster of claim 1, further comprising:

a) a gate located at least one of the first or second stations, the gate movable between open and closed positions by a gate actuator, with the gate in the closed position blocking movement of the trolley in a forward direction and with the gate in the open position allowing movement of the trolley in a forward direction;

b) a sensor located along the respective rail section associated with the gate, the sensor capable of sensing the trolley;

c) a controller having an input from the sensor and an output to the gate actuator, the controller causing the gate to be closed while a trolley is located in the respective rail section.

9. The indoor zip coaster of claim 8, wherein the sensor is an entry sensor located at an entry to the respective rail section, further comprising:

a) an exit sensor located at an exit of the respective rail section, the exit sensor connected to the controller;

b) the controller causing the gate to be closed while a trolley is between the entry and exit sensors on the respective rail section.

* * * * *